US005788074A

United States Patent [19]

Tanabe et al.

[11] Patent Number: 5,788,074

[45] Date of Patent: *Aug. 4, 1998

[54] PACKAGE FOR CONTAINING PHOTO-PRINTS WITH PHOTOGRAPHIC FILM CASSETTE

[75] Inventors: Zenya Tanabe; Koji Yoshida, both of Tokyo, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 618,150

[22] Filed: Mar. 19, 1996

[30] Foreign Application Priority Data

Mar. 24, 1995 [JP] Japan ..... 7-066202

[51] Int. Cl.[6] ..... B65D 85/671

[52] U.S. Cl. ..... 206/455; 206/232; 206/389; 229/117.05

[58] Field of Search ..... 206/455, 232, 206/578, 389, 449, 225, 465, 470, 775, 779; 40/701, 704, 775, 776; 229/117.05; 383/120

[56] References Cited

U.S. PATENT DOCUMENTS

| | | | |
|---|---|---|---|
| 4,966,285 | 10/1990 | Otake et al. | 206/455 |
| 5,016,752 | 5/1991 | Haugen, Jr. | 206/455 |
| 5,251,745 | 10/1993 | Repp et al. | 206/455 |
| 5,251,746 | 10/1993 | Gresh et al. | 206/455 |
| 5,271,497 | 12/1993 | Blackman et al. | 206/455 |
| 5,314,066 | 5/1994 | Gresh . | |
| 5,332,168 | 7/1994 | Shibata et al. . | |

*Primary Examiner*—M. D. Patterson
*Assistant Examiner*—Luan K. Bui
*Attorney, Agent, or Firm*—Sughrue, Mion, Zinn, Macpeak & Seas, PLLC

[57] ABSTRACT

A package is provided with a cassette container section for containing a photographic film cassette, a photo-print container section for containing a stack of plural photo-prints, and an index print container section for containing an index print. The photographic film cassette contains a developed photographic filmstrip in a form of a roll. The index print has reduced-size positive images which correspond to respective frames of the photographic filmstrip and which are arranged in a matrix.

22 Claims, 4 Drawing Sheets

PACKAGE FOR CONTAINING PHOTO-PRINTS WITH PHOTOGRAPHIC FILM CASSETTE

BACKGROUND OF THE INVENTION

1. Field of the Invention

The present invention relates to a package for containing a photographic film cassette including a developed photographic filmstrip, plural photo-prints made from the filmstrip and an index print.

2. Description Related to the Prior Art

In conventional photo-printing systems, a user removes a used photographic film cassette from a camera and takes it to a photofinisher. In the photofinisher, an exposed filmstrip of the photographic film cassette is pulled out of a cassette shell, and is developed with a film processor. The developed filmstrip is set in a photo-printer wherein frames on the developed filmstrip are printed on photographic paper. The printed photographic paper is developed and then cut by each frame into plural photo-prints. After the printing, the developed filmstrip is cut by a predetermined length into film pieces which are inserted in a film sheath. The film sheath and the plural photo-prints are packed in a DP bag and returned to the user.

Recently, photo-printing systems of a new type have been proposed for a photographic film cassette having a film-advancing mechanism for example, as disclosed in U.S. Pat No. 5,332,168. In the photofinisher, a developed filmstrip after making photo-prints is contained again fully in the cassette shell while being wound around a spool. Thereafter the photofinisher gives the user the photo-prints and the photographic film cassette containing the developed filmstrip. In the new photo-printing systems, the user also receives an index print in which reduced-size positive images corresponding to the respective frames of the developed filmstrip are arranged in a matrix. Such an index print helps the user to know contents of the frames formed on the filmstrip and to distinguish specific images, for example, to order for extra prints.

The conventional DP bag is designed suitably for containing the photo-prints and the film sheath. Accordingly, if the photographic film cassette is included in the DP bag, the photographic film cassette easily slips off from the DP bag due to its block shape, during treating the DP bag. Especially, when the photographic film cassettes slip off from some of plural DP bags, the photographic film cassettes may be lost which one of the DP bags corresponds to one of the photographic film cassettes. In this case, to visually check the photographic film cassettes with respect to the DP bags should be performed, but it may include some troubles since the photographic filmstrip of each photographic film cassette is fully contained in the cassette shell.

Accordingly, it has been desired to provide a package capable of containing the photographic film cassette stably. It has also been desired to contain the index print easily to see it when the package is opened. Furthermore, it has been desired to make the package with a simple construction at a low cost.

OBJECT OF THE INVENTION

In view of the foregoing problems, an object of the present invention is to provide a package for containing a photographic film cassette stably together with photo-prints with a simple construction at a low cost.

Another object of the present invention is to provide a package capable of containing an index print with ease to see the index print while the package is opened.

SUMMARY OF THE INVENTION

In order to achieve the above objects and other objects and advantages of this invention, a package is provided with a cassette container section for containing a photographic film cassette, a photo-print container section for containing a stack of photo-prints and a cover for covering the cassette container section and the photo-print container section. An index print is contained in an index print container section.

In a preferred embodiment of the present invention, a foldable sheet is utilized. The sheet has a main section and a flap section. The main section includes a first pocket for receiving a stack of the photo-prints and a second pocket for receiving the photographic film cassette. Inside the flap section, a third pocket is mounted for receiving the index print. In this embodiment, since the foldable sheet is utilized, the construction of the package becomes simple. The space for stacking the packages in the photofinisher should be small. The user may preserve the packages while the packages are piled one over another.

In another preferred embodiment of the present invention, a box and a flap are provided. The box has an opening formed at one end thereof and the flap covers the opening. The plural photo-prints are contained in the box in a stacked condition. The flap has a first pocket for receiving the photographic film cassette. The first pocket is inserted in the box when the flap is closed. In this embodiment, the construction of the package becomes simple.

In a further preferred embodiment of the present invention, a rectangular sleeve and a drawer are provided. The rectangular sleeve has at least one opening side through which the drawer is insertable in the rectangular sleeve. The drawer is constituted of a sheet and a box mounted on one end of the sheet. The photo-prints are placed on the sheet one over another, and the photographic film cassette is put in the box. In this embodiment, the overall shape of the package likes a long thin box, so that the package is convenient to preserve plural packages.

In still another preferred embodiment of the present invention, a foldable sheet is utilized. The sheet has a main section, a subsidiary flap section and a main flap section. The subsidiary flap section is bent along a first fold line so as to be almost perpendicular with the main section. The main flap section is bent along a second fold line so as to overlap within the main section. In the main section, a first pocket is formed for containing the plural photo-prints in the stacked condition. In the subsidiary flap section, a second pocket is formed for containing the photographic film cassette. The main flap section has a third pocket in which an index print is inserted. In this embodiment, a foldable sheet is utilized so that the construction becomes simple and the space for preservation may be small.

BRIEF DESCRIPTION OF THE DRAWINGS

The above objects and advantages of the present invention will become more apparent from the following detailed description when read in connXection with accompanying drawings, in which.

DETAILED DESCRIPTION OF THE PREFERRED EMBODIMENTS OF THE PRESENT INVENTION

Figure 1:
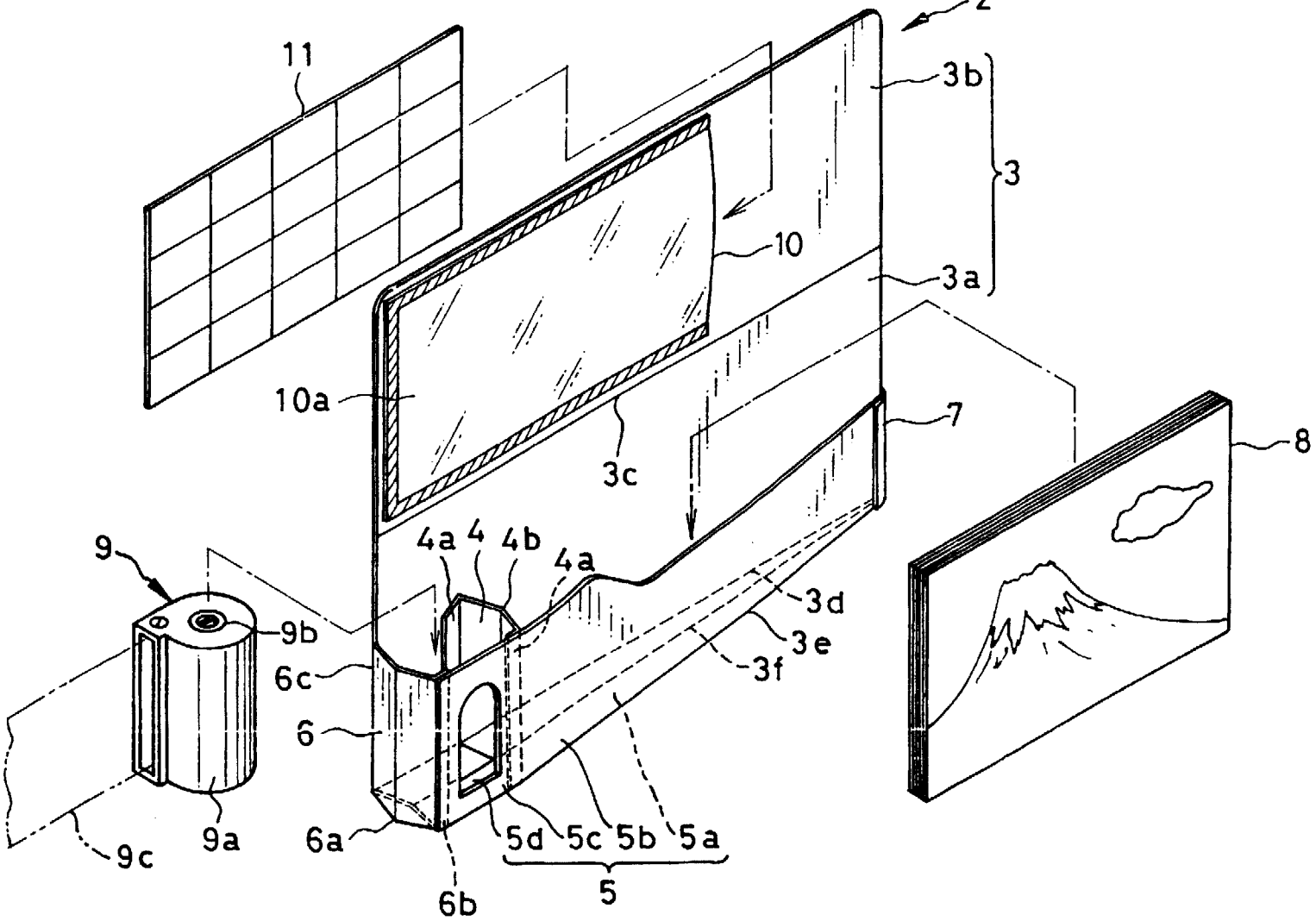
FIG. 1 his an explanatory view illustrating a package according to a embodiment of the present invention.

FIG. 1 illustrates a package 2 according to a first preferred embodiment of the present invention. The package 2 is formed of foldable sheet, for example, a cardboard 3 and a cardboard chip 4 about 0.3 mm thick. It is suitable for the cardboards 3 and 4 to be coated with resin to make the package 2 stable. The cardboard 3 includes a main section 3*a* and a flap section 3*b*, which are defined by a fold line 3*c* which is parallel with an edge of the flap section 3*b*.

The main section 3*a* is longer than the flap section 3*b* in a direction perpendicular to the fold line 3*c*. A pocket portion 5 is formed by folding the main section 3*a* along fold lines 3*d* and 3*e* parallel with the fold line 3*c*. The pocket portion 5 is provided with a gusset 5*a* forming the bottom defined by fold lines 3*d* and 3*e*, and a gusset 6 at the side of the pocket portion 5. The gussets 5*a* and 6 are each provided with a center fold line 3*d*, 6*a* longitudinally along which the gussets 5*a* and 6 may be folded flatly. The gusset 6 is formed integrally with the main section 3*a*. An end or overlap flap 6*b* of the gusset 6 is attached to the front of the pocket portion 5 via adhesive agent. Also, a segment or overlap flap 7 is formed integrally with the main section 3*a* and attached to the front of the pocket portion 5.

The pocket portion 5 is sectioned by the cardboard chip 4 into a photo-print pocket 5*b* and a cassette pocket 5*c*. Opposite ends or overlap flaps 4*a* of the cardboard chip 4 are respectively attached inside the pocket portion 5. The cardboard chip 4 has a center fold line 4*b* parallel with the fold line 6*a*. A stack of plural photo-prints 8 are inserted into the photo-print pocket 5*b*, and a photographic film cassette 9 is inserted into the cassette pocket 5*c*. An opening 5*d* is formed in the cassette pocket 5*c* in order to easily take the photographic film cassette 9 out from the cassette pocket 5*c*.

On the flap section 3*b*, an index print pocket 10 is provided for holding an index print 11. The index print pocket 10 is constituted of a rectangular piece 10*a* of transparent sheet, e.g., thin vinyl sheet. Three edges of the rectangular transparent sheet 10*a* are attached to the inside surface of the flap section 3*b*, as indicated by hatched portions in FIG. 1, while one edge of the sheet remains free.

The photographic film cassette 9 is constituted of a cassette shell 9*a*, a spool 9*b* and a photographic filmstrip 9*c*. The spool 9*b* is rotatably contained in the cassette shell 9*a*. The photographic filmstrip 9*c* is wound on the spool 9*b* and entirely contained in the cassette shell 9*a*. Upon rotating the spool 9*b* in the film unwinding direction, a leading end of the photographic filmstrip 9*c* is advanced outside the cassette shell 9*a*.

The index print 11 is made from the frames on the exposed photographic filmstrip 9*c* which are converted into plural positive images and arranged in a matrix on a photographic paper in a reduced size. With reference to the index print 11, the user can know the contents of the respective frames of the photographic filmstrip 9*c* as contained in the cassette shell 9*a*.

To produce the package 2, first, the cardboards 3 and 4 are cut from the cardboard sheet. At that time, the main section 3*a* is provided with the gusset 6 including the overlap flap 6*b*, the opening Sd and the overlap flap 7. The fold lines 3*c*, 3*d*, 3*e*, and 6*c* are respectively provided in the cardboard 3 for defining the main and flap sections 3*a* and 3*b*, and the gussets 5*a* and 6. The center fold lines 3*f* and 6*a* are also provided. Further fold lines are formed to define the overlap flaps 6*b* and 7. Similarly, the cardboard chip 4 is provided with the center fold line 4*b*, and fold lines to form the overlap flaps 4*a* at opposite sides.

The cardboards 3 and 4 are folded along respective fold lines. The overlap flaps 6*b* and 7 of the cardboard 3 are folded and attached via adhesive agents to the respective surfaces of the cardboard 3 at predetermined positions to form the pocket portion 5. The cardboard chip 4 after folding the both overlap flaps 4*a* is attached to the inside wall of the pocket portion 5 via the adhesive agent so as to direct a surface of the cardboard 4 to an inside wall of the gusset 6. Thereby the pocket portion 5 is sectioned into the photo-print pocket portion 5*a* and the cassette pocket 5*c*. The rectangular vinyl sheet 10*a* is attached to the inside of the flap section 3*b* while one edge is left free for insertion of the index print 11 therethrough.

After exposing all frames of the photographic filmstrip 9*c*, the photographic film cassette 9 is unloaded from the camera. The photographic film cassette 9 is taken to a photofinisher. In the photofinisher, the exposed photographic filmstrip 9*c* is pulled from the cassette shell 9*a* and developed. The index print 11 is made. Thereafter, the developed photographic filmstrip 9*c* is wound into the cassette shell 9*a*. If the photofinisher receives an order of making photo-prints from the user further to developing, the photofinisher also makes the photo-prints 8 before winding the developed filmstrip 9*c* into the cassette shell 9*a*. After the photofinishing, the photographic film cassette 9 having the developed photographic filmstrip 9*c* entirely contained in the cassette shell 9*a* is returned to the user with the index print 11.

The photo-prints 8, the photographic film cassette 9 and the index print 11 corresponding to one order are inserted respectively into the pockets 5*b*, 5*c* and 10 by manual or an inserter device. The inserted photographic film cassette 9 lays beside the stack of the photo-prints 8 and the flap portion 3*b* covers the pocket portion 5 when the package 2 is folded along the fold line 3*c*, and the package 2 is returned to the user.

The package 2 according to this embodiment adopts the cardboard having a flexibility suitable for making the package mainly by folding. Accordingly, manufacturing process of the package 2 can be simplified, and it is possible to execute economic production of a large number of packages 2. Moreover, the center fold lines 3*f*, 6*a* and 4*b* are applied for folding the gussets 5*a* and 6 and the cardboard chip 4 flatly, so as to prevent the stack of the packages 2 from bulking up. This is suitable for stacking a large number of packages 2 before use thereof.

The package 2 is convenient for the user to preserve the photo-prints 8, the photographic film cassette 9 and the index print 11 all together. Moreover, the photographic film cassette 9 is kept in the cassette pocket 5*c* and covered with the flap section 3*b*, so as not to slip off from the package 2. The index print pocket 10 of the transparent sheet enables the user to see the index print 11 as contained in the index pocket 10. The user can know easily the contents of the photographic filmstrip 9*c* with reference to the index print 11 for ordering extra printing or any other cases only by opening the flap section 3*b*. Furthermore, the index print 11 can be prevented from its degration since the index print 11 is always kept in the index pocket 10.

Figure 2:
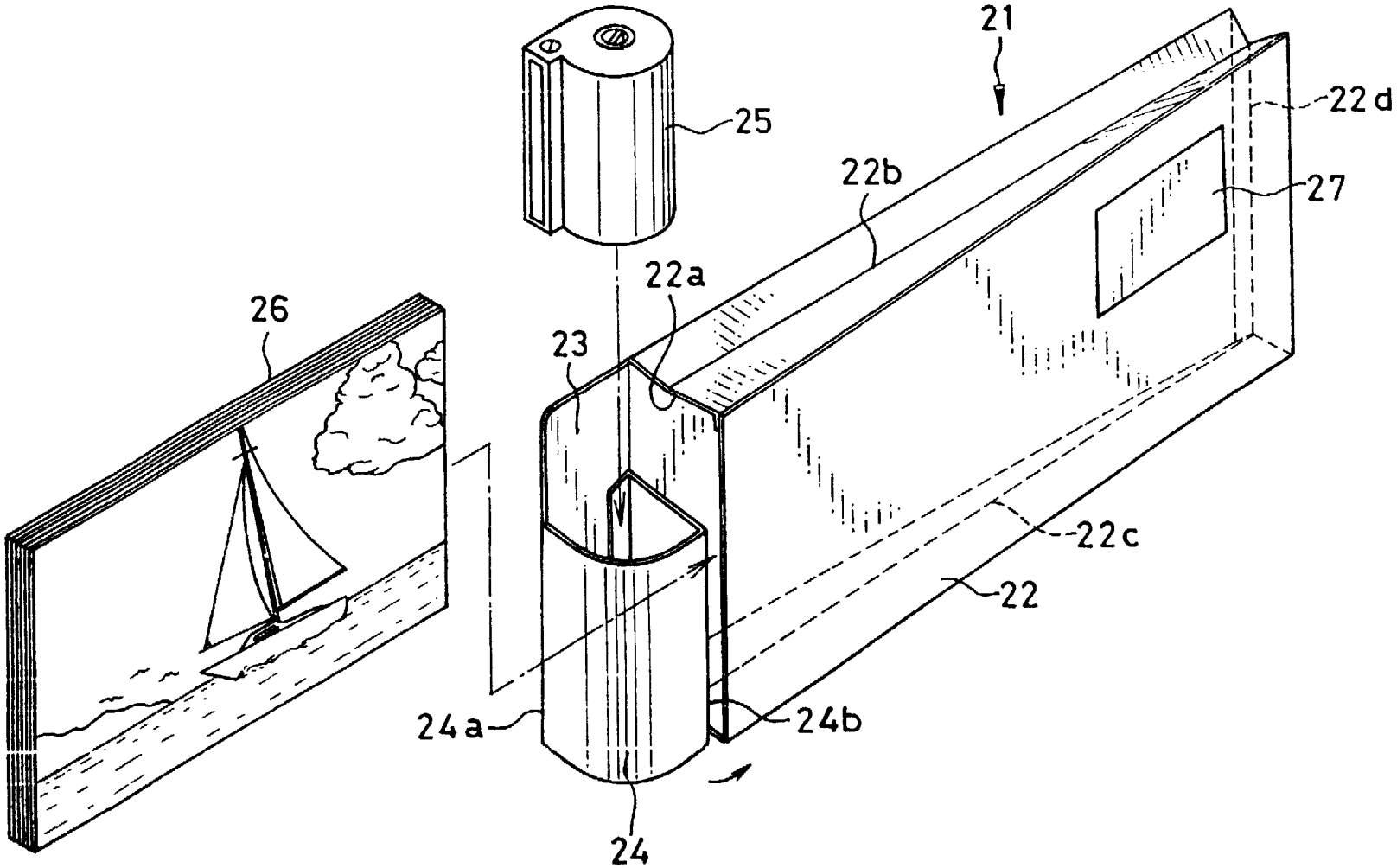
FIG. 2 is an explanatory view illustrating a package according to a second embodiment of the present invention.

FIG. 2 illustrates a package 21 according to a second embodiment of the present invention. The package 21 is made from foldable sheet, e.g., cardboard coated with resin, and constituted of a main container 22 in a gusset bag shape, a flap 23 and a cassette container 24 formed on the flap 23.

The main container 22 has an opening 22*a* at one end in a longitudinal direction. Fold lines 22*b* and 22*c* are respectively provided along opposite sides in the longitudinal direction, and a fold line 22*d* is also provided along a side opposite to the opening 22*a*. The flap 23 is formed integrally with the main container 22. The cassette container 24 is formed by bending a portion extended from the flap 23 along fold lines 24*a* and 24*b* in a cylindrical shape for coaxially receiving a photographic film cassette 25. The main container 22 receives plural of photoprints 26. The cassette container 24 is insertable into the main container 22 through the opening 22*a*. At that time, the opening 22*a* is closed by the flap 23. The cassette container 24 in the main container 22 is positioned beside one side edges of the photo-prints 26. Note that a numeral 27 represents a sheet label for an order form. The label 27 is provided with prints, such as a name, date of photofinishing, order contents. The label 27 is stuck on the package 21 at the time of making the photo-prints 26 or containing the photographic film cassette 25.

Note that an index print is omitted from FIG. 2, but the index print can be contained in the main container 22 together with the photo-prints 26. In this embodiment, since the package 21 can be formed from one sheet of cardboard without any separate parts, the steps for producing the package 21 are decreased. Of course, the flap 23 may be a separate part and attached to the main container 22.

The fold lines 22*b*, 22*c*, and 22*d* serve to fold the main container 22 flatly and the fold lines 24*a* and 24*b* also serve to fold the cassette container 24, so that the package 21 can be folded flatly. Accordingly, it is possible to compactly stack the packages 21.

Figure 3:
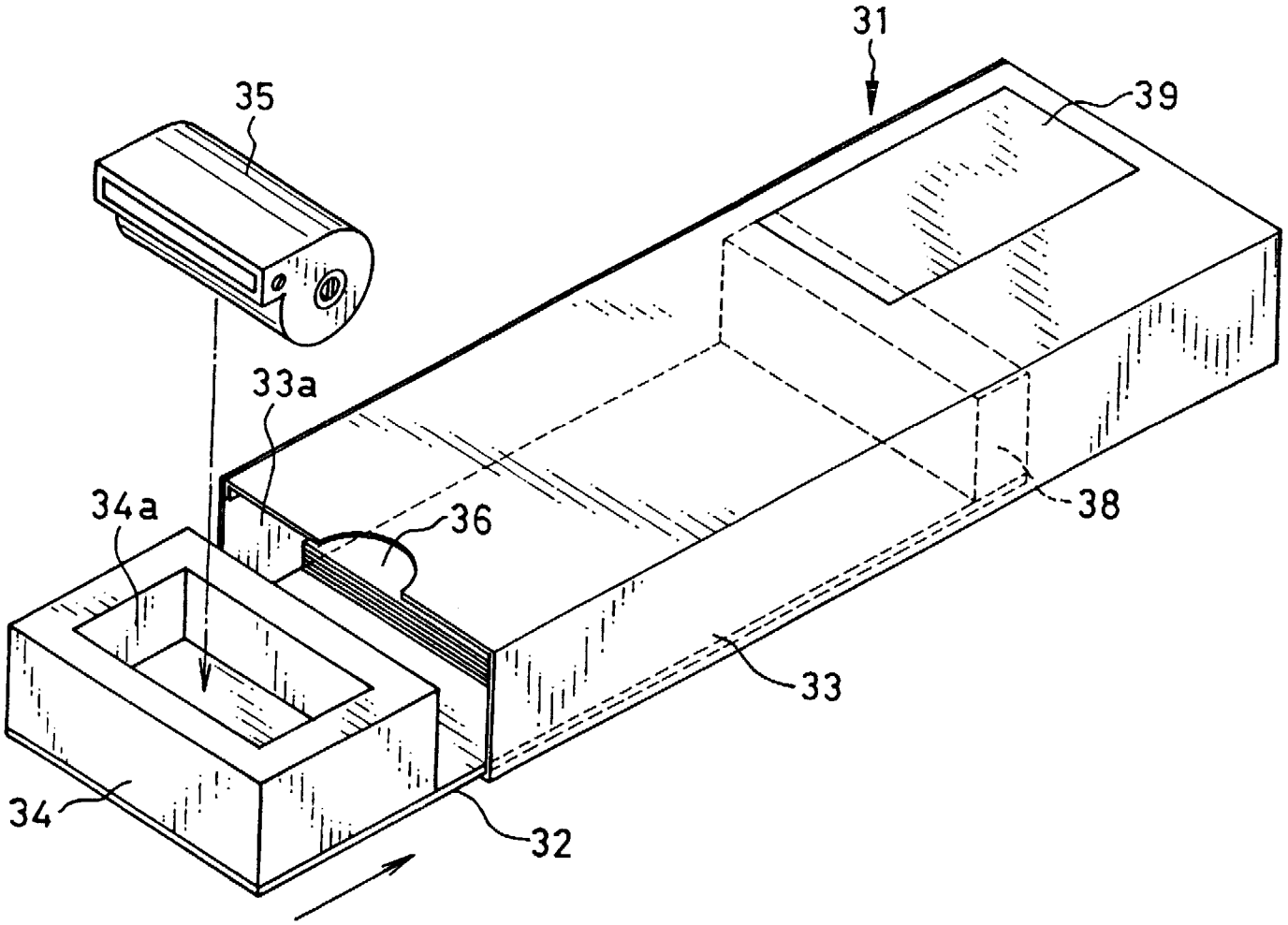
FIG. 3 is an explanatory view illustrating a package according to a third embodiment of the present invention.

FIG. 3 illustrates a package 31 of a box shape according to a third embodiment of the present invention. The package 31 is constituted of a tray 32 and a sleeve holder 33 in a rectangular cylinder shape. The holder 33 has an opening side 33*a* at one end through which the tray 32 is insertable into the holder 33. The holder 33 may be provided with another opening side opposite to the opening side 33*a*. A cassette container 34 is mounted on the tray 32 at one end so as to shut the opening side 33*a* when the tray 32 is contained in the case 33. The cassette container 34 is a box with a recess 34*a* for receiving a photographic film cassette 35 in a laying state. A stack of photo-prints 36 are put on the tray 32. A block 38 is also mounted on the tray 32 at the other end so as not to leave the photo-prints 36 in the sleeve holder 33 when the tray 32 is drawn out of the sleeve holder 33. The tray 32 and the sleeve holder 33 are formed of cardboard and the cassette container 34 and the block 38 are formed of a light plastic material, e.g., a foamed plastic.

Note that an index print is omitted from FIG. 3, but it is possible to contain the index print on the tray 32 together with the photo-prints 36. Note that a numeral 39 represents a label sheet like the label 27.

The package 31 is suitable for being stacked at a large number stably because of its box shape. Further, when a large number packages 31 are piled up, the cassette container 34 and the block 38 of the foamed plastic can serve to prevent the packages 31 from being crushed flat. It is easy to take the photographic film cassette 35 and the photo-prints 36 out from the package 31 because the user only pull the tray 32 from the holder 33.

Figure 4:
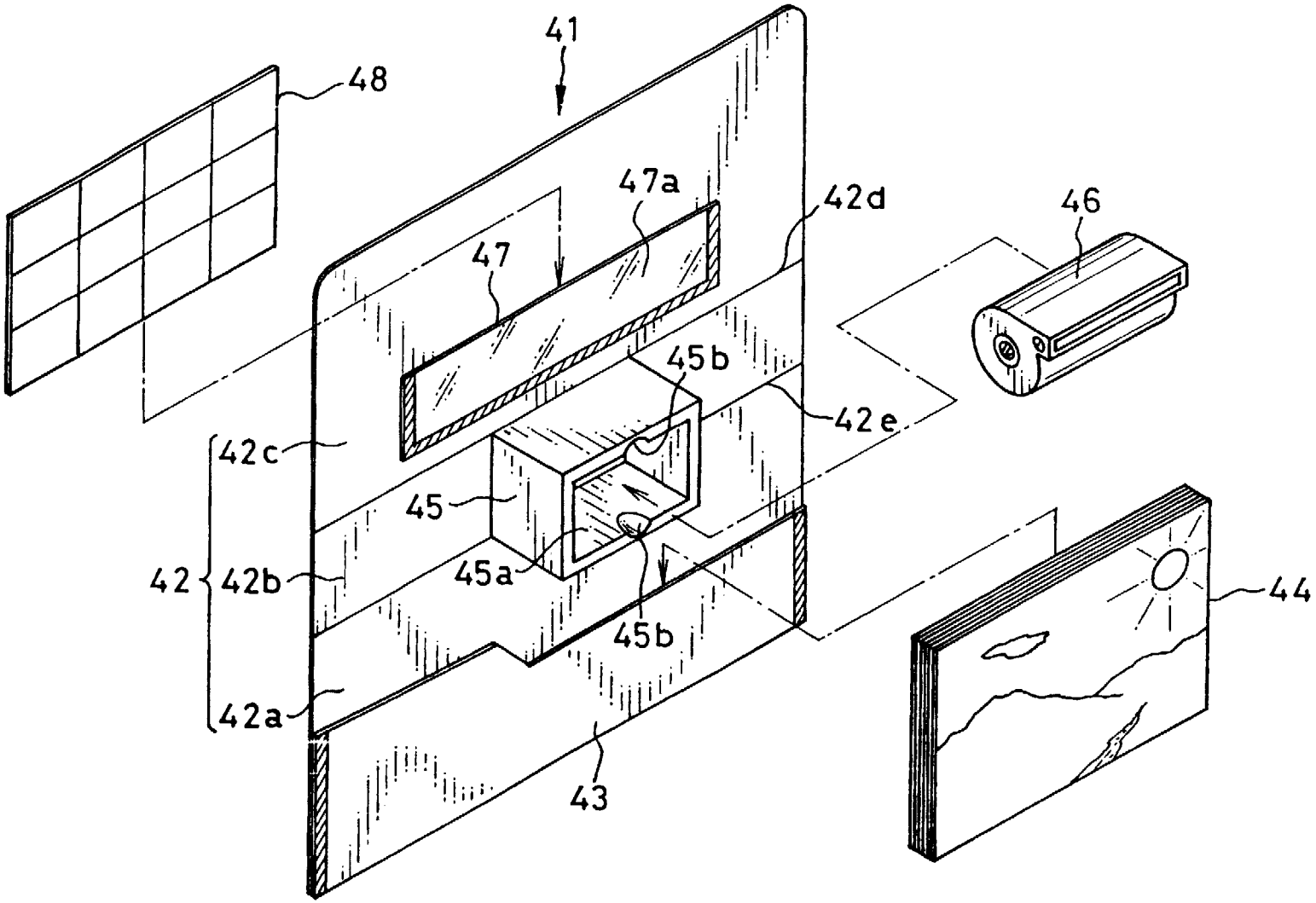
FIG. 4 is an explanatory view illustrating a package according to a fourth embodiment of the present invention.

FIG. 4 illustrates a package 41 according to a fourth embodiment of the present invention. The package 41 is constituted of a base 42 formed of rectangular foldable sheet, e.g., cardboard coated with resin. The base 42 includes a main section 42*a*, an intermediate section 42*b* and a flap section 42*c*, which are defined by a pair of fold lines 42*d* and 42*e* parallel with an edge of the base 42. The main section 42*a* is longer than the flap section 42*b* in a direction perpendicular to the fold lines 42*d* and 42*e*.

A photo-print pocket 43 is formed by folding the main section 42*a* and securing both lateral sides as shown by hatched portions in FIG. 4 for containing plural photo-prints 44. The photo-print pocket 43 may be provided with a gusset similarly to the pocket portion 5 of the package 2 in the first embodiment so that a stack of the photo-prints 46 are inserted easily therein. The center of the intermediate section 42*b* is provided with a cassette container 45 of a light plastic material, e.g., a foamed plastic, with a recess 45*a* for receiving a photographic film cassette 46 while an axis of a spool of the photographic film cassette 46 is parallel with the fold lines 42*d* and 42*e*. The cassette container 45 has opposite notches 45*b* in order that the photographic film cassette 46 held in the cassette container 45 is easily taken out. When the base 42 is folded along the fold lines 42*d* and 42*e*, the cassette container 45 is positioned beside the one side edges of the stacked photo-prints 44 so as to prevent the photo-prints 44 from slipped off from the photo-print pocket 43. An index print pocket 47 has a rectangular piece of transparent sheet 47*a*, e.g., thin vinyl sheet. The transparent sheet 47*a* is attached to the inside of the flap section 42*c* via three edges thereof as shown by hatched portions in FIG. 4. An index print 48 is inserted into the index print pocket 47 from a free edge of the transparent sheet 47*a*.

It is possible to form a cassette container with a piece of cardboard instead of the cassette container 45 made of foamed plastic. The piece is attached to the intermediate section 42*b* so as to form a cylindrical space for receiving the photographic film cassette 46.

In the embodiments described so far, the packages 21, 31 and 41 are formed by folding and attaching the overlap flaps at the predetermined positions with adhesive agent similarly to the package 2 of the first embodiment. But the packages may be formed by inserting the overlap flaps into slits formed in the packages at predetermined positions.

It is to be noted that the above-described cassette containers 5*c*, 24, 34 and 45 each have a recess or a cylindrical space and the recess or space may be adjusted in a size slightly larger than that of the photographic film cassette so that the photographic film cassette can be held tightly in the cassette container. It is hence possible to prevent the photographic film cassette from dropping out.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A package in combination with a photographic film cassette and plural photo-prints which are contained in said package comprising:

a cassette container section for containing said photographic film cassette, said cassette container section having a first opening from which said photographic film cassette is inserted, said photographic film cassette having a cassette shell, a spool, and a developed photographic filmstrip, said cassette shell supporting said spool in rotatable fashion, said spool having said photographic filmstrip entirely wound thereon, said photographic filmstrip to be advanced when said spool is rotated in an unwinding direction, said photographic filmstrip having plural frames recorded thereon to be originals of said photo-prints;

a photo-print container section for containing a stack of said photo-prints, said photo-print container section having a second opening from which said stack of said photo-prints are inserted; and a cover for covering said first opening and said second opening to prevent said photographic film cassette and said photo-prints from slipping off respectively from said cassette container section and said photo-print container section wherein said cassette container section is configured to securely receive said film cassette and said cassette container section has a smaller size than said photo-print container section, wherein said cassette container section and said photo-print container section are respectively defined by at least one accordion side wall.

2. A package as defined in claim 1, further comprising an index print container section for containing an index print in which reduced-size positive images corresponding to said respective frames of said photographic film are arranged in a matrix.

3. A package as defined in claim 1, wherein said cassette container section and said photo-print container section are disposed immediately adjacent each other.

4. A package as defined in claim 3, wherein said cassette container section and said photo-print container section are separated by a flexible wall.

5. A package as defined in claim 4, wherein said flexible wall is cardboard.

6. A package as defined in claim 1, wherein said cover is pivotable about a horizontal fold line.

7. A package as defined in claim 4, wherein first and second openings extend in a vertical direction, perpendicular to said fold line.

8. A package as defined in claim 2, wherein said index print container section is provided on said cover.

9. A package as defined in claim 8, where said index print section has a third opening into which said index print is inserted.

10. A package as defined in claim 9, wherein said third opening faces perpendicular to said first and second openings.

11. A package as defined in claim 1, where said cassette container section has a substantially cylindrical shape.

12. A package as defined in claim 1, wherein a width of said cassette container section is substantially smaller than a corresponding width of said photo-print container section.

13. A package in combination with a photographic film cassette and plural photo-prints which are contained in said package, said photographic film cassette comprising a developed photographic filmstrip in a form of a roll, said photographic filmstrip having plural frames recorded thereon to be originals of said photo-prints, and said package comprising:

a sheet having a main section and a flap section, said flap section being foldable along a first fold line so as to overlap within said main section;

a first pocket provided inside of said main section for containing a stack of said photo-prints;

a second pocket formed in parallel with said first pocket for securely containing said photographic film cassette; and a third pocket provided inside said flap section for containing an index print in which reduced-size positive images corresponding to said respective frames of said photographic filmstrip are arranged in a matrix, said pockets being of different sizes, wherein said first Pocket and said second pocket are formed by sectioning a fourth pocket with a partition member; and wherein said fourth pocket comprises a first portion defined by folding a part of said main section inward to form a front wall and a bottom wall, and second and third portions, each contiguous with said main section, to form opposite side walls by joining an end of each of said second and third portions to said first portion.

14. A package as defined in claim 13, wherein said third pocket is formed with a transparent sheet attached to an inside wall of said flap section via first, second and third edges excluding a fourth edge, and said fourth edge forms an opening from which said index print is inserted.

15. A package as defined in claim 14, wherein said fourth edge is perpendicular to said first fold line.

16. A package as defined in claim 14, wherein one of said opposite side walls constituting said second pocket and said partition member are each provided with a fold line along a direction perpendicular to said first fold line and said bottom wall is provided with a fold line parallel to said first fold line, so that said first pocket and said second pocket are folded flatly.

17. A package as defined in claim 13, wherein said second pocket has a substantially cylindrical shape.

18. A package as defined in claim 13, wherein a width of said second pocket is substantially smaller than a corresponding width of said first pocket.

19. A package in combination with a photographic film cassette and plural photo-prints which are contained in said package comprising:

a cassette container section for containing said photographic film cassette, said cassette container section having a first opening from which said photographic film cassette is inserted, said photographic film cassette having a cassette shell, a spool, and a developed photographic filmstrip, said cassette shell supporting said spool in rotatable fashion, said spool having said photographic filmstrip entirely wound thereon, said photographic filmstrip to be advanced when said spool is rotated in an unwinding direction, said photographic filmstrip having plural frames recorded thereon to be originals of said photo-prints;

a photo-print container section for containing a stack of said photo-prints, said photo-print container section having a second opening from which said stack of said photo-prints are inserted; and a cover for covering said first opening and said second opening to prevent said photographic film cassette and said photo-prints from slipping off respectively from said cassette container section and said photo-print container section wherein said cassette container section is configured to securely receive said film cassette and said cassette container section has a smaller size than said photo-print container section, wherein said cassette container section includes another opening for facilitating removal of said film cassette from said cassette container section.

20. A package for containing a photographic film cassette and plural photo-prints, said photographic film cassette containing a developed photographic filmstrip in a form of a roll, said photographic filmstrip having plural frames recorded thereon to be originals of said photo-prints, said package comprising:

a cassette container section for containing said photographic film cassette, said cassette container section having a first opening from which said photographic film cassette is inserted;

a photo-print container section for containing a stack of said photo-prints, said photo-print container section having a second opening from which said stack of said photo-prints are inserted; and a cover for covering said first opening and said second opening to prevent said photographic film cassette and said photo-prints from slipping off respectively from said cassette container section and said photo-print container section wherein said cassette container section is configured to securely receive said film cassette, wherein said cassette container section and said photo-print container section are respectively defined by at least one accordion-like sidewall.

21. A package for containing a photographic film cassette and plural photo-prints, said photographic film cassette containing a developed photographic filmstrip in a form of a roll, said photographic filmstrip having plural frames recorded thereon to be originals of said photo-prints, said package comprising:

a sheet having a main section and a flap section, said flap section being foldable along a first fold line so as to overlap within said main section;

a first pocket provided inside of said main section for containing a stack of said photo-prints;

a second pocket formed in parallel with said first pocket for securely containing said photographic film cassette; and a third pocket provided inside said flap section for containing an index print in which reduced-size positive images corresponding to said respective frames of said photographic filmstrip are arranged in a matrix;

wherein said third pocket is formed with a transparent sheet attached to an inside wall of said flap section via first, second and third edges excluding a fourth edge, and said fourth edge forms an opening from which said index print is inserted;

wherein said fourth edge is perpendicular to said first fold line;

wherein said first pocket and said second pocket are formed by sectioning a fourth pocket with a partition member;

wherein said fourth pocket comprises a first portion defined by folding a part of said main section inward to form a front wall and a bottom wall, and second and third portions, each contiguous with said main section, to form opposite side walls by joining an end of each of said second and third portions to said first portion.

22. A package as defined in claim 21, wherein one of said opposite side walls constituting said second pocket and said partition member are each provided with a fold line along a direction perpendicular to said first fold line and said bottom wall is provided with a fold line parallel to said first fold line, so that said first pocket and said second pocket are folded flatly.

* * * * *